US008870180B2

(12) United States Patent
Le

(10) Patent No.: US 8,870,180 B2
(45) Date of Patent: Oct. 28, 2014

(54) DIFFERENTIAL TO REDUCE SKEW

(71) Applicant: Hewlett-Packard Development Company, L.P., Houston, TX (US)

(72) Inventor: Huy Le, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/780,296

(22) Filed: Feb. 28, 2013

(65) Prior Publication Data

US 2014/0239581 A1 Aug. 28, 2014

(51) Int. Cl.
*B65H 3/06* (2006.01)
*B65H 9/00* (2006.01)

(52) U.S. Cl.
CPC ..... *B65H 9/00* (2013.01); *B65H 2403/483* (2013.01); *B65H 9/002* (2013.01); *B65H 3/0669* (2013.01)
USPC ..... 271/114; 271/226

(58) Field of Classification Search
CPC . B65H 3/0669; B65H 9/002; B65H 2403/483
USPC ..... 271/114, 226
See application file for complete search history.

(56) References Cited

U.S. PATENT DOCUMENTS

| | | | | |
|---|---|---|---|---|
| 4,395,152 | A | 7/1983 | Hendrischk | |
| 5,278,624 | A | 1/1994 | Kamprath et al. | |
| 5,323,945 | A | 6/1994 | Matoushek | |
| 6,167,232 | A | 12/2000 | Jimenez et al. | |
| 6,575,458 | B2 | 6/2003 | Williams et al. | |
| 6,866,260 | B2 | 3/2005 | Williams et al. | |
| 7,334,787 | B2 * | 2/2008 | Akiyama et al. | 271/258.01 |
| 8,085,412 | B2 | 12/2011 | Nishitani et al. | |
| 8,403,320 | B2 * | 3/2013 | Lu | 271/114 |
| 2012/0001386 | A1 | 1/2012 | Nishikata et al. | |
| 2013/0020757 | A1 * | 1/2013 | Lu | 271/226 |
| 2013/0234387 | A1 * | 9/2013 | Moto | 271/228 |

FOREIGN PATENT DOCUMENTS

| | | | | |
|---|---|---|---|---|
| DE | 102007031082 | | 1/2009 | |
| JP | 63230451 A | * | 9/1988 | B65H 9/16 |
| JP | 05186121 A | * | 7/1993 | B65H 29/58 |
| JP | 2009078882 | | 4/2009 | |
| WO | WO-2009020350 | | 2/2009 | |

* cited by examiner

*Primary Examiner* — Gerald McClain

(74) *Attorney, Agent, or Firm* — Aaron Ward

(57) ABSTRACT

An apparatus includes a differential to receive a primary driving force, and provide a first driving force and a second driving force. A first pick wheel is to transfer the first driving force to a sheet. A second pick wheel is to transfer the second driving force to the sheet. The differential is to balance the first driving force and the second driving force to reduce skew in the sheet and feed the sheet along a feed path of a printer. The first pick wheel and the second pick wheel are aligned perpendicular to the feed path at an offset from the differential.

15 Claims, 10 Drawing Sheets

DIFFERENTIAL TO REDUCE SKEW

BACKGROUND

Sheet transport systems, for example in a scanner or printer, may cause a sheet to become skewed. A skewed sheet may result in degraded print quality, and may result in increased device wear and paper jams associated with a need for downtime and servicing.

BRIEF DESCRIPTION OF THE DRAWINGS/FIGURES

DETAILED DESCRIPTION

Reducing sheet skew in sheet transport systems can avoid quality degradations in printouts and avoid printer jams, for example. Skew can arise when a sheet interacts with a sheet driving mechanism. For example, a pick mechanism may use pick wheels to pick a sheet of paper from a stack of papers in a paper tray of a printer, scanner, or other device. Multiple pick wheels may be mounted to a rigid shaft, and traction between the sheet of paper across the pick wheels may not be distributed equally through all wheels. Driving the rigid shaft therefor may skew the sheet, as one wheel may have less traction than another, introducing unbalanced torque to skew the sheet. Nonhomogeneous material in the pick wheels may generate differences in coefficients of friction (and corresponding traction) for the pick wheels. Elasticity of dual modulus wheel material may differ between the wheels, affecting the deformation of the wheel under force and resulting in differences in surface contact areas of the wheels, affecting traction. Other factors affecting thrust forces of the wheels include variations in wheel roundness, operational vibrations of a system affecting contact between the wheel and sheet, buckling of the sheet or other situations, including situations that can lift the pick mechanism causing loss of contact between the wheel and the sheet. These and other various factors can affect driving forces delivered by the wheels to the sheet, skewing the sheet under the unbalanced forces.

Examples provided herein include a differential to reduce skew, e.g., in a media advancing system to interact with a sheet, enabling increased levels of threshold accuracy specifications for skew tolerance. For example, skew tolerance may be reduced to a threshold below 1.5 mils of positive or negative skew.

Figure 1:
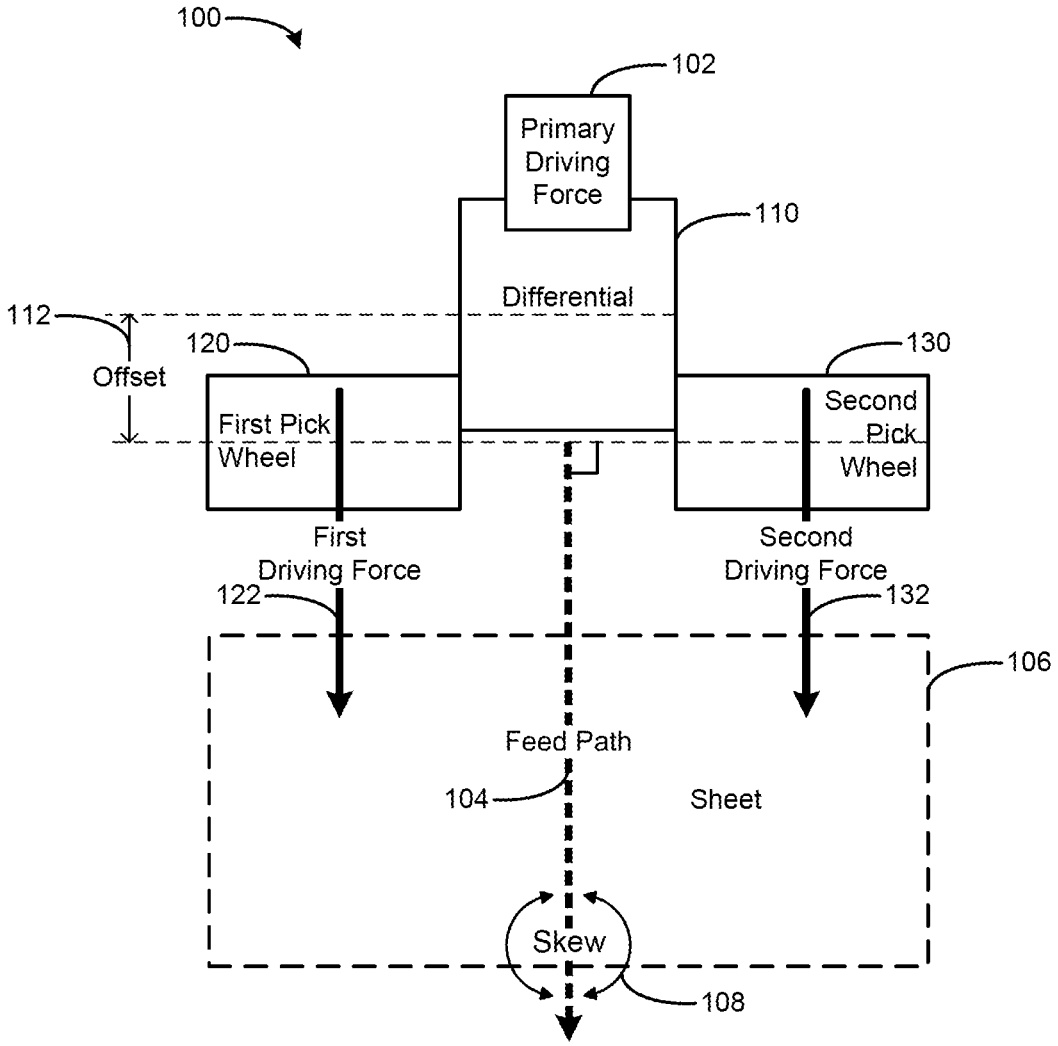
FIG. 1 is a block diagram of an apparatus including a differential according to an example.

FIG. 1 is a block diagram of an apparatus 100 including a differential 110 according to an example. Apparatus 100 also includes a first pick wheel 120 and a second pick wheel 130. The differential 110 is to receive primary driving force 102, and provide the first driving force 122 to the first pick wheel 120, and provide the second driving force 132 to the second pick wheel 130. The first pick wheel 120 and second pick wheel 130 are provided at an offset 112 from the differential, to drive the sheet 106 along feed path 104. The differential 110 enables skew 108 to be reduced when feeding the sheet along the feed path 104. The first pick wheel 120 and the second pick wheel 130 are perpendicular to the feed path 104.

The differential 110 enables the pick mechanism apparatus 100 to continuously self-adjust or self-balance the thrust forces (first driving force 122 and second driving force 132) that are to drive the sheet 106, thereby reducing skew 108 of the sheet 106. The apparatus 100 is capable of delivering even thrust forces between the first pick wheel 120 and the second pick wheel 130, even when faced with phenomena such as unbalanced traction that may otherwise affect a sheet handling mechanism. The first pick wheel 120 and the second pick wheel 130 are arranged substantially perpendicular to the feed path 104, enabling the action of the differential 110 to deskew the sheet 106 toward alignment with the feed path 104.

For example, one of the pick wheels 120, 130 may lift relative to the sheet 106, due to the hardness of the sheet 106 or other issue, such that traction of that wheel drops and there may be an instant where one of the pick wheels is not providing the full driving force to the sheet 106. If the remaining pick wheel in contact with the sheet 106 were to provide the full primary driving force 102 to the sheet 106, the sheet 106 may be skewed. The differential 110 enables balancing of the first driving force 122 and the second driving force 132, such that unbalanced driving forces are not applied to the sheet 106. For example, if the first pick wheel 120 lifts up from paper (or otherwise suffers reduced traction), the differential 110 enables the remaining second pick wheel 130 to reduce its driving force corresponding to the reduced traction of the first pick wheel 120. If the first pick wheel 120 is lifted off the sheet 106 and has zero traction, the differential 110 enables the second pick wheel 130 (in contact with the sheet 106) to stop spinning, even if the primary driving force 102 is driving the differential 110.

Furthermore, the differential 110 may adjust the first driving force 122 and the second driving force 132 to enable a skewed sheet 106 to become deskewed. For example, the skewed sheet 106 may be driven along the feed path 104 and the differential 110 enables the sheet 106 to rotate even when in contact with both the first pick wheel 120 and the second pick wheel 130. The sheet 106 may be rotated even while ensuring each pick wheel maintains good contact and traction with the sheet 106.

Figure 2:
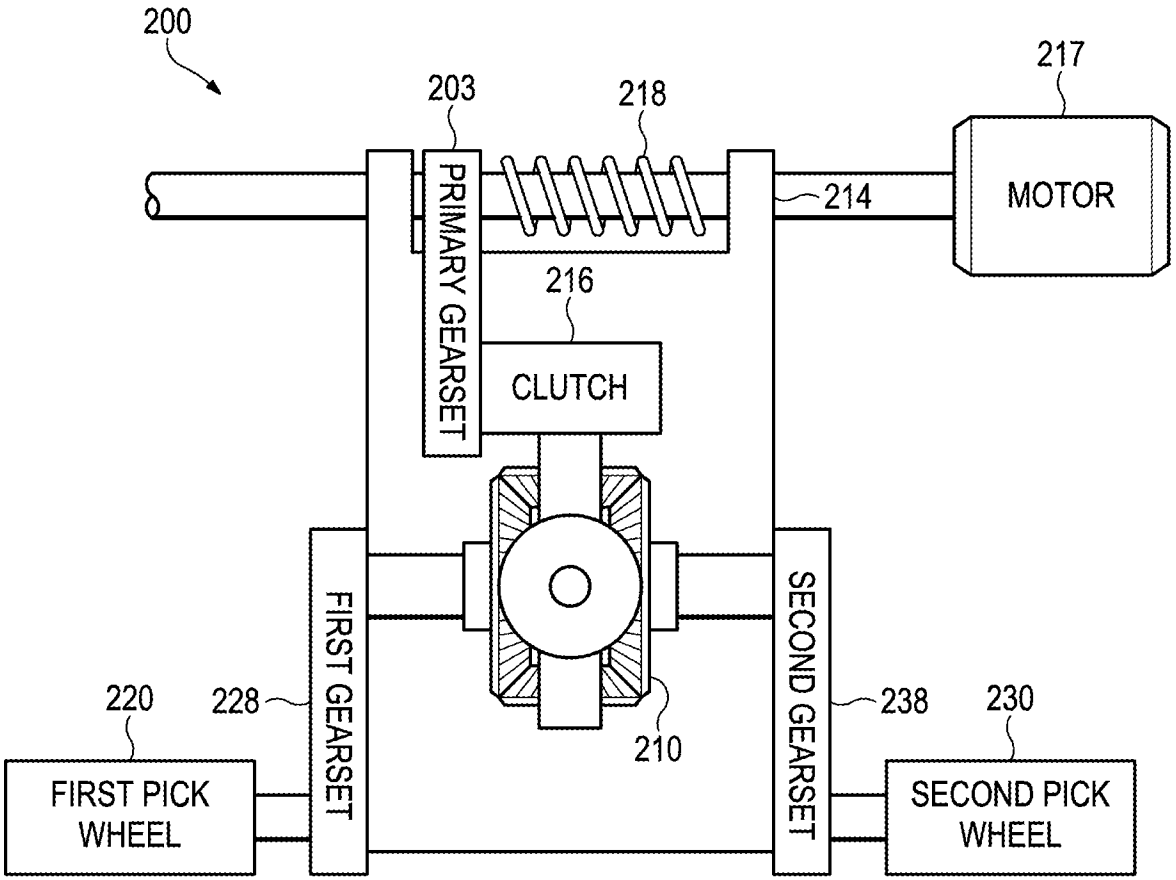
FIG. 2 is a block diagram of an apparatus including a differential according to an example.

FIG. 2 is a block diagram of an apparatus 200 including a differential 210 according to an example. Apparatus 200 also includes motor 217 to provide a primary driving force to the differential 210 via primary gearset 203 and clutch 216. The differential 210 is to provide a first driving force to the first pick wheel 220 via the first gearset 228. The differential 210 also is to provide a second driving force to the second pick wheel 230 via the second gearset 238. Apparatus 200 may pivot about the pick pivot 214. Spring 218 may bias the pivoting of apparatus 200 about the pick pivot 214.

The differential 210 enables skew reduction and/or correction, based on driving the first pick wheel 220 and the second pick wheel 230. The differential may be mechanical. The example differential 210 shown in FIG. 2 is formed by bevel gears, although other alternatives are possible (e.g., spur gears, planetary gears, and so on). Examples may include other forms of differentials, such as electronically regulated differentials and so on. The bevel gear differential 210 provides compact and light weight operational footprint.

The clutch 216 may be used to couple the motor 217 to the differential 210. The clutch 216 may be a one-way clutch mechanism, to isolate the differential 210 from forces provided by the motor 217. For example, the clutch 216 may prevent reverse motion of the motor 217 from, e.g., pulling backward on a sheet that is to be driven forward along the feed path. A single clutch 216 may provide beneficial clutch operation to both the first pick wheel 220 and the second pick wheel 230, via the operation of the differential 210. Thus, in the example shown in FIG. 2, separate clutches for each pick wheel are not needed, although in alternate examples multiple clutches 216 may be used.

Depending on desired torque and speed characteristics for a given application (e.g., a pick speed for a particular printer), gearsets may be used on the output or input of the differential 210. Furthermore, the gearsets enable the differential to be offset from the pick pivot 214 and/or an axis of the pick wheels 220, 230. A primary gearset 203 may couple the motor 217 to the clutch 216 and/or differential 210. A first gearset 228 may couple the differential 210 to the first pick wheel 220, and a second gearset 238 may couple the differential 210 to the second pick wheel 230. Such gear trains may adjust the final speed and torque at a pick wheel, and may take into account the capabilities of the motor 217. Gearsets may be reduction gearsets, neutral gearsets, or multiplication gearsets. Additionally, characteristics of the motor 217 may be adjusted (e.g., choosing a motor 217 having a different speed and/or torque, and/or driving the motor 217 with a different voltage and/or current) to adjust speed and torque of the apparatus 200, and may be chosen to complement the gearsets (or lack thereof).

The spring 218 may provide a bias for apparatus 200 about the pick pivot 214, to generate a contact force between the pick wheels and a sheet to be driven. Thus, one spring 218 may bias both pick wheels to provide traction. In alternate examples, multiple springs may be provided, and/or the pick wheels may rely on independent suspension with independent springs. In alternate examples, the spring 218 may be omitted, such that a weight of the apparatus 200 biases the pick wheels against the sheet to be driven, to provide traction. Even if one pick wheel has higher traction than the other, e.g., due to differently sized wheels, different rates of wearing out over time, and/or initial manufacturing variations, the differential 210 enables balancing of the forces applied to the sheet. Even with low grip (e.g., slippery paper), the differential 210 enables the pick wheels to spin multiple times until both the first pick wheel 220 and the second pick wheel 230 have enough traction to push the sheet further (including compensating for temporary changes in traction of either wheel over time).

Figure 3:
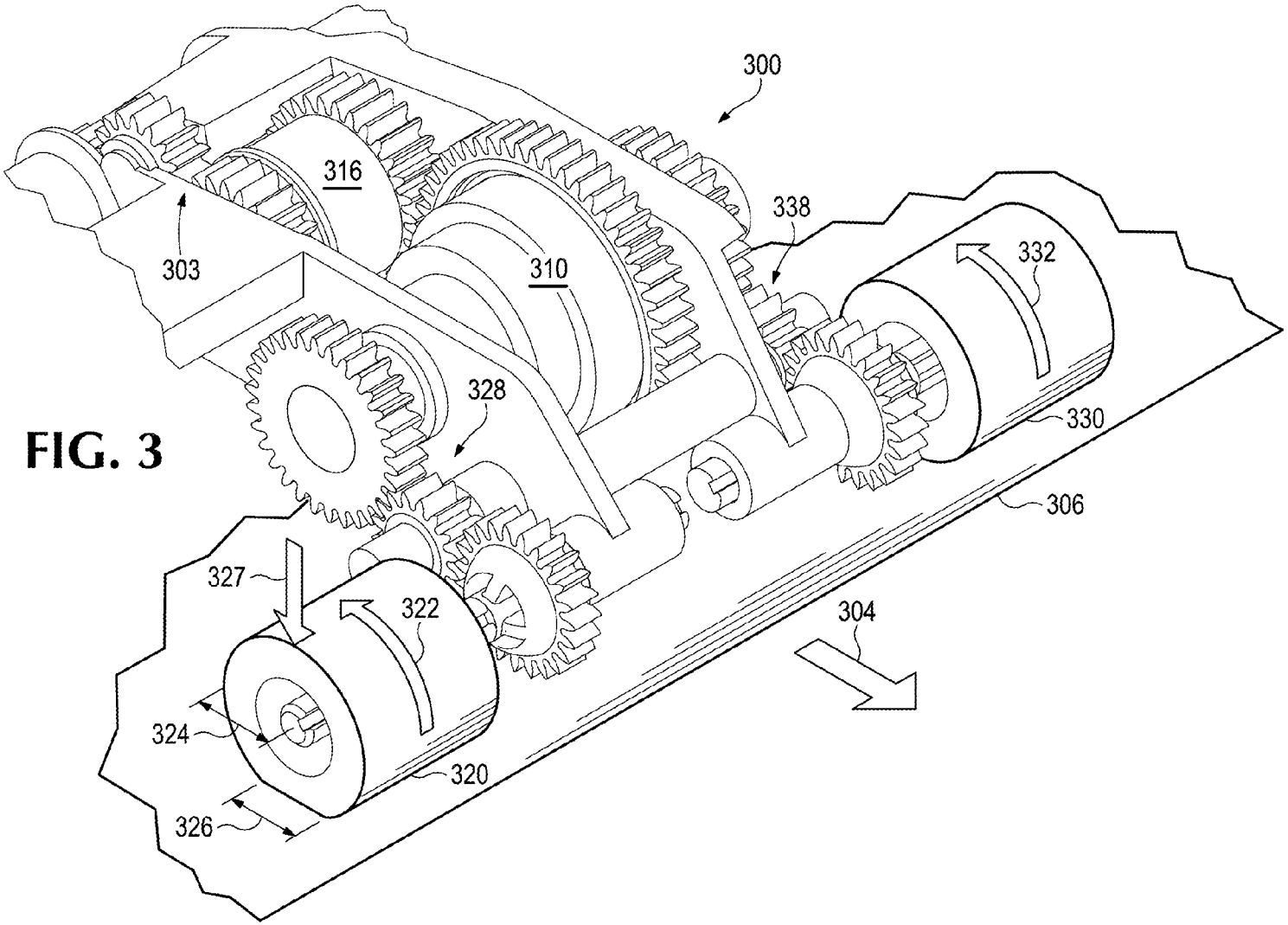
FIG. 3 is a perspective view of an apparatus including a differential according to an example.

FIG. 3 is a perspective view of an apparatus 300 including a differential 310 according to an example. The differential 310 is coupled to the clutch 316 via primary gearset 303. The differential 310 is coupled to the first pick wheel 320 via the first gearset 328. The differential 310 is coupled to the second pick wheel 330 via the second gearset 338. The differential 310 may balance a first driving force 322 and a second driving force 332 applied to sheet 306, to reduce skew in the sheet 306 and drive the sheet 306 along the feed path 304. A pick wheel may be associated with diameter 324, contact area 326, and traction 327.

The apparatus 300 is shown positioned to engage the sheet 306, based on gravity causing the apparatus 300 to pivot to allow contact with the sheet 306. In alternate examples, a spring may be used to bias the apparatus 300 in contact with the sheet 306. The primary gearset 303 may receive a primary driving force, e.g., via a drive shaft from a motor, such that the apparatus 300 is pivotable while receiving the primary driving force. The primary gearset 303 is to transfer the primary driving force to the differential 310.

The example apparatus 300, including differential 310, may deliver nearly even torque to each of the pick wheels and reduce skew in the sheet 306, even if traction 327 with sheet 306 is unbalanced between the first pick wheel 320 and the second pick wheel 330. A drive train (e.g., power delivery including a drive shaft, primary gearset 303, first gearset 328, and second gearset 338) may supply as much torque as necessary to a pick wheel to drive the sheet 306. However, the traction 327 under a particular pick wheel may affect the amount of torque that can be delivered from that pick wheel to the sheet 306, before the pick wheel starts to slip. Apparatus 300 may compensate for such variations in traction 327, to deskew and align the sheet 306 with the feed path 304.

In an example, the apparatus 300 may drive the sheet 306 along a straight line (feed path 304), enabling the differential 310 to take action, as needed, to compensate for any differences in diameter 324 between the first pick wheel 320 and the second pick wheel 330. For a given rotational velocity, the linear velocity applied to the sheet 306 by a pick wheel may be a function of the diameter 324. A larger diameter 324 in the first pick wheel 320 could generate a higher linear velocity than the second pick wheel 330 if both wheels were to rotate at the same rotational velocity, and differences in linear velocities may cause skew in the sheet 306. A larger diameter 324 in the first pick wheel 320 also could cause increased traction compared to the second pick wheel 330, if the pick wheel axles are maintained equidistant from the sheet 306, again leading to potential skew in the sheet 306. The apparatus 300 may avoid such skew, by compensating for different diameters 324 and/or traction 327. For example, apparatus 300 may cause a smaller diameter pick wheel (that would drive the sheet 306 at lower linear velocity for a given rotational velocity) to run at a higher rotational velocity compared to the other pick wheel, whose diameter 324 would be relatively larger (which would otherwise generate a relatively higher linear velocity if driven at the same rotational velocity), thereby equalizing the first driving force 322 and the second driving force 332 transferred to the sheet 306. In another example, one pick wheel having a larger diameter 324 may provide relatively higher traction 327 and/or a relatively larger contact area 326, such that the apparatus 300 may drive that pick wheel at a relatively lower rotational velocity to compensate for reduced traction (e.g., potential slippage) in the other pick wheel that is driven at a relatively higher rotational velocity, to equalize the first driving force 322 and the second driving force 332 transferred to the sheet 306.

Differences between the first pick wheel 320 and the second pick wheel 330 may arise due to various reasons, such as different rates of wear, different materials (e.g., non-homogeneity of the tire compounds, different coefficients of friction, different elasticity and/or deformation characteristics), different manufacturing tolerances, different residue on the pick wheels and/or sheet 306, and other factors. In addition to these aspects of the pick wheels, other factors acting on the pick wheels also have the potential to affect the first driving force 322 and the second driving force 332 that would be applied to the sheet 306. For example, the normal force applied to either side of the apparatus 300 may differ (due to the weight distribution or spring forces biasing the apparatus 300 toward the sheet 306). A pick wheel may lose contact with the sheet 306 due to vibration or other forces. Such factors may lead to one pick wheel having less traction than the other, but the differential 310 may balance torque between the first pick wheel 320 and the second pick wheel 330 to avoid unbalanced torque that would exacerbate skewness of the sheet 306 (i.e., skew the paper away from alignment with the feed path 304).

In the example of FIG. 3, the first pick wheel 320 is experiencing contact area 326, in contrast to the second pick wheel 330 whose contact area is shown approximating zero, i.e., the second pick wheel 330 is shown not touching the sheet 306 (e.g., during a vibration or other disturbance). The apparatus 300 may allow the second pick wheel 330 to spin at a speed, e.g., twice the spin speed of the differential 310 based on the coupling ratio between the second pick wheel 330 and the differential 310 multiplication effect. Thus, the differential 310 may be allowed to spin, even without advancing the sheet 306, thereby ensuring that the torque provided by the first pick wheel 320 (first driving force 322) does not reach a threshold torque that would skew the sheet 306. In an alternate example, if the second pick wheel 330 has some traction with sheet 306 (i.e., less than the first pick wheel 320), the apparatus 300 enables the second pick wheel 330 to spin faster than the first pick wheel 320 to compensate for the traction deficit, thereby balance the first driving force 322 and the second driving force 332. Thus, apparatus 300 enables a lower traction pick wheel to spin faster than a higher traction pick wheel (e.g., when the paper has an uneven slipperiness across its surface, or other unbalancing states of the pick wheels 320, 330), enabling the linear velocities on both sides of sheet 306 to remain closely balanced.

Figure 4:
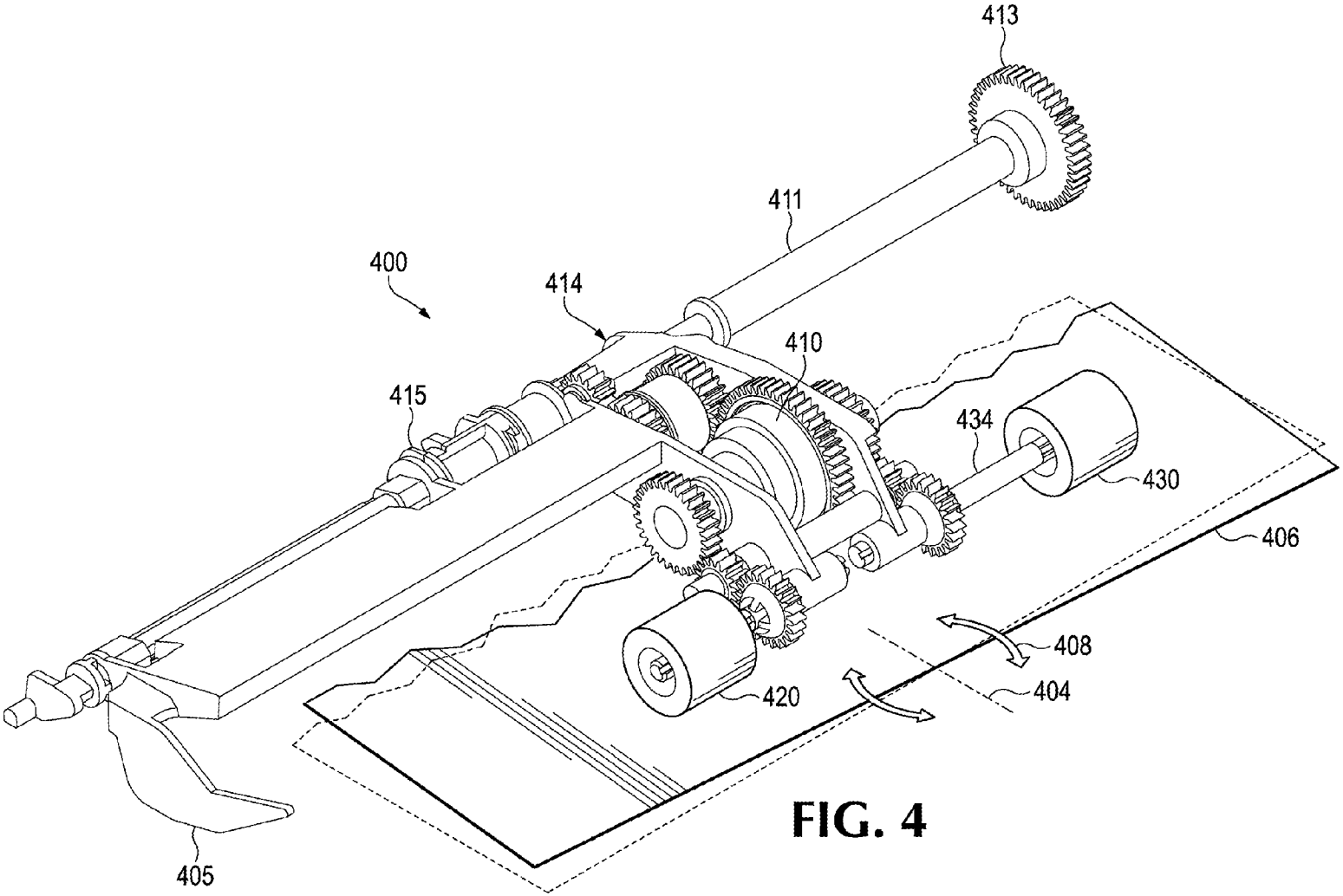
FIG. 4 is a perspective view of an apparatus including a differential according to an example.

FIG. 4 is a perspective view of an apparatus 400 including a differential 410 according to an example. The differential 410 is to drive the first pick wheel 420 and second pick wheel 430, to reduce skew 408 in sheet 406 when driving sheet 406 along feed path 404. A pick wheel may be driven by a pick wheel axle 434. The differential 410, first pick wheel 420, and second pick wheel 430 are pivotable about the pick pivot 414. Apparatus 400 may be caused to pivot by actuating the lift arm 405.

The apparatus 400 is pivotable about a drive shaft 411 that is to receive the primary driving force via a drive gear 413. A cam mechanism 415 may be used to engage and disengage the drive shaft 411 to selectively transfer a primary driving force to the pick mechanism apparatus 400.

The first pick wheel 420 and the second pick wheel 430 may be associated with independent axles 434, which may have various lengths, including lengths equal or unequal to each other. A particular length of axle 434 may depend on an orientation of apparatus 400 relative to the entire system (e.g., a printer). If a particular design includes any constraints in positioning the pick wheels, the axle 434 may be adjusted (e.g., arranging the pick wheels symmetrically about the differential, or asymmetrically to accommodate a particular feed path or mechanism). Differing axle lengths 434 may be associated with different degrees of axle flex that may introduce traction and/or wear differences between the first pick wheel 420 and the second pick wheel 430. However, the apparatus 400 may accommodate such potential differences in traction without introducing skew 408 when feeding sheet 406 along the feed path 404.

Apparatus 400 may include various supports, including lift arm 405. The lift arm 405 may include a tab to enable lifting of the entire pick mechanism apparatus 400. In an example, the tab may interact with a paper tray, such that the lift arm 405 may lift the apparatus 400 and cause it to pivot out of the way when the paper tray is inserted and/or removed.

Figure 5:
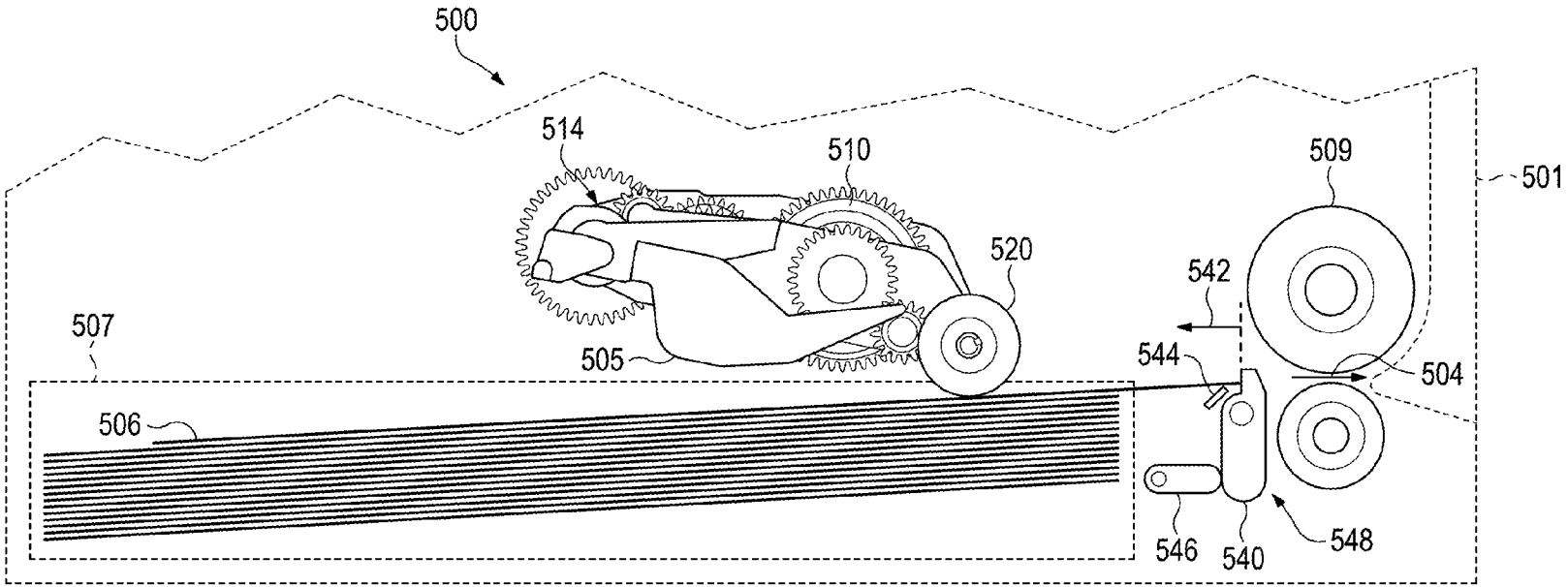
FIG. 5 is a side view of an apparatus including a differential and a gate according to an example.

FIG. 5 is a side view of an apparatus 500 including a differential 510 and a gate 540 according to an example. The apparatus 500 is to pivot about pick pivot 514, so that pick wheel 520 is to contact sheet 506. Lift arm 505 may be actuated to cause the apparatus 500 to pivot. For example, removal and insertion of tray 507 from printer body 501 may actuate the lift arm 505 to raise and lower the apparatus 500. Pick wheel 520 is shown driving sheet 506 along the feed path 504, toward the turn roller 509. Gate 540 is shown in a deployed position 548, providing gate resistance force 542 to sheet 506. A gate sensor 544 is shown, as well as a gate interlock 546, that may affect actuation of the gate 540.

The apparatus 500 may operate on a stack of sheets 506 in tray 507. After picking some sheets 506, a level of the sheets may change as sheets are picked off the stack. The apparatus 500 may then pivot about pick pivot 514 to reach every sheet 506 in the tray 507.

The apparatus 500 including differential 510 is to deskew sheet 506 upon feeding the sheet 506 along the feed path 504, even in examples not based on the gate 540. Gate 540 may provide additional features, although in alternate examples the gate 540 may be omitted. The gate 540 may be passive, based on a spring load or gravity to bias the gate 540 into the deployed position 548 as shown. In alternate examples, the gate 540 may be active. For example, a controller may actuate gate 540 independently of gravity, based on input from the gate sensor 544 and whether sheet 506 is detected in alignment with the gate 540. Apparatus 500 also may use a gate interlock 546 (e.g., a cam, clutch, or other mechanism) to lock the gate 540 in the deployed position 548. The gate sensor 544 may be used to actuate the gate interlock 546 for active interlocking, although in alternate examples the interlock 546 may be passively actuated based on pressure from the sheet 506 against multiple gates 540. A plurality of gates 540 may be used. Thus, the interlock 546 may prevent the sheet 506 from advancing until the sheet 506 is aligned and pushing on more than one of the gates 540. In an example, a passive interlock 546 remains engaged until the sheet 506 applies enough pressure to a plurality of gates 542 to overcome the gate resistance force 542, causing the interlock 546 to disengage and allow the gate 540 to assume a retracted position.

The gate 540 may contribute to the pick mechanism apparatus 500 deskewing the sheet 506 prior to feeding the sheet 506 along the feed path 504 into the turn roller 509. For example, a sheet 506 may be so skewed (e.g., improperly loaded into tray 507) that the pick mechanism apparatus 500 may feed the sheet 506 with a slight amount of remaining skew on the way toward the turn roller 509. The leading edge of the skewed sheet 506, referred to as the positive skew side, may contact one of the gates 540 and receive the gate resistance force 542, preventing the positive skew side from further advancing. Meanwhile, action of the apparatus 500 (e.g., via differential 510 or other components) enables the sheet 506 to continue deskewing such that the other side of the sheet 506 (negative skew side) continues toward the turn roller 509 until contacting gate 540. In an example, the gate 540 comprises a plurality of subgates arranged to align an edge of the sheet 506 perpendicular to the feed path 504. When the sheet 506 is aligned (e.g., at least two sides of the sheet 506 contact the gates 540), the gate 540 receives increased output torque of the pick mechanism apparatus 500, compared to when the sheet 506 is undergoing alignment (e.g., with only one positive skew side of the sheet 506 contacting the gate 540). The increased torque may be the combined force of the first and second driving forces from the first and second pick wheels. The combined force thereby may meet or exceed the gate resistance force 542, such that the gate 540 then may disengage to allow the deskewed sheet 506 to pass. When the trailing edge of sheet 506 is released to the turn roller 509, the gates 540 may return to the deployed position 548.

Figure 6:
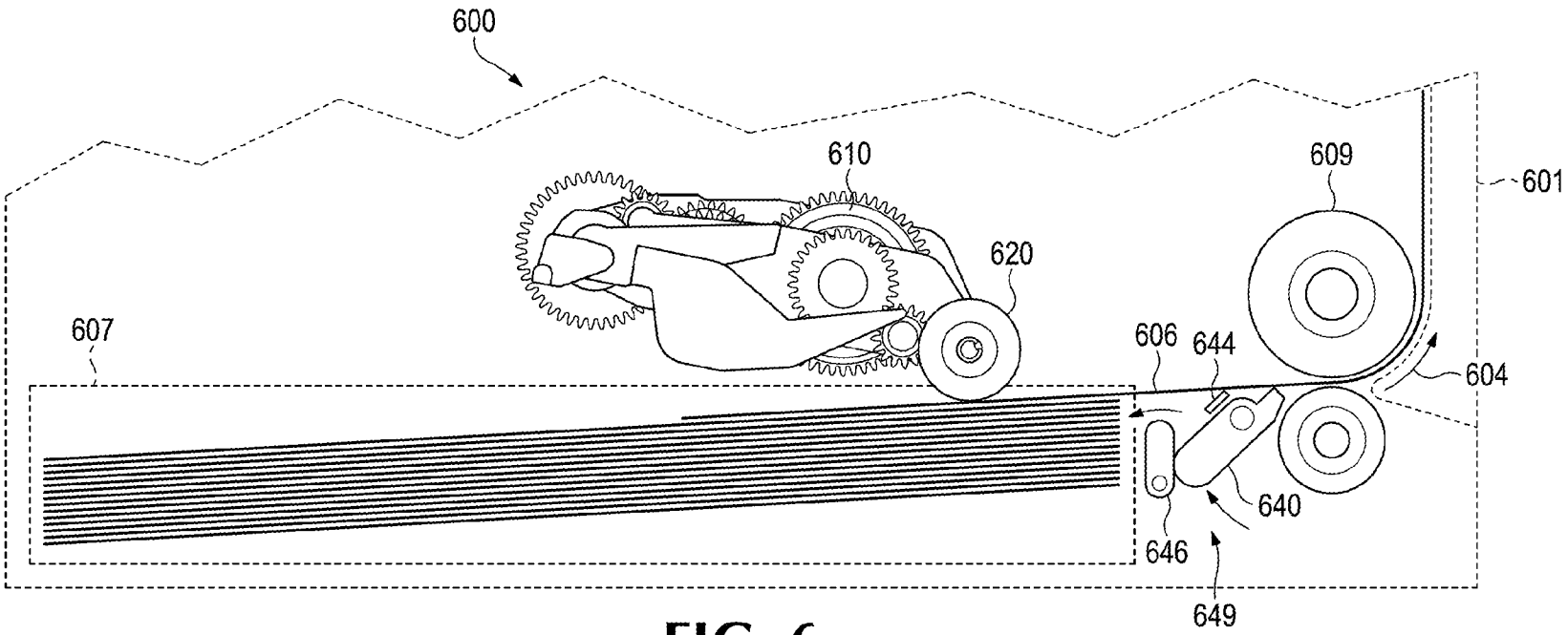
FIG. 6 is a side view of an apparatus including a differential and a gate according to an example.

FIG. 6 is a side view of an apparatus 600 including a differential 610 and a gate 640 according to an example. The gate 640 is shown in a retracted position 649, enabling sheet 606 to be driven along the feed path 604 around the turn roller 609. The gate 640 may operate based on gate interlock 646 and gate sensor 644. The differential 610 may drive the pick wheel 620 to pick sheet 606 from the tray 607 in the printer body 601.

In an example, a plurality of gates 640 include a plurality of interlocks 646 and sensors 644. Upon first picking the sheet, the sensors 644 initially had all registered the presence of the advancing leading edge of the sheet 606, and enabled the apparatus 600 to disengage the interlocks 646 and the gates 640. When the trailing edge of the sheet 606 passes the sensors 644, the apparatus 600 may engage the gates 640 and the interlocks 646 to receive the next sheet from the tray 607. In alternate examples, the interlock 646 may be omitted and the apparatus 600 may actively control the gate 640 to emulate the functionality of an interlock (e.g., based on the sensors 644). The gate 640 is able to retract and allow the sheet 606 to advance without introducing skew to the paper. For example, a plurality of gates/subgates are to be retracted simultaneously so as not to introduce a skew torque to the sheet 606 (e.g., if one out of a total of two subgates were to retract such that the remaining deployed gate introduced skew).

Figure 7:
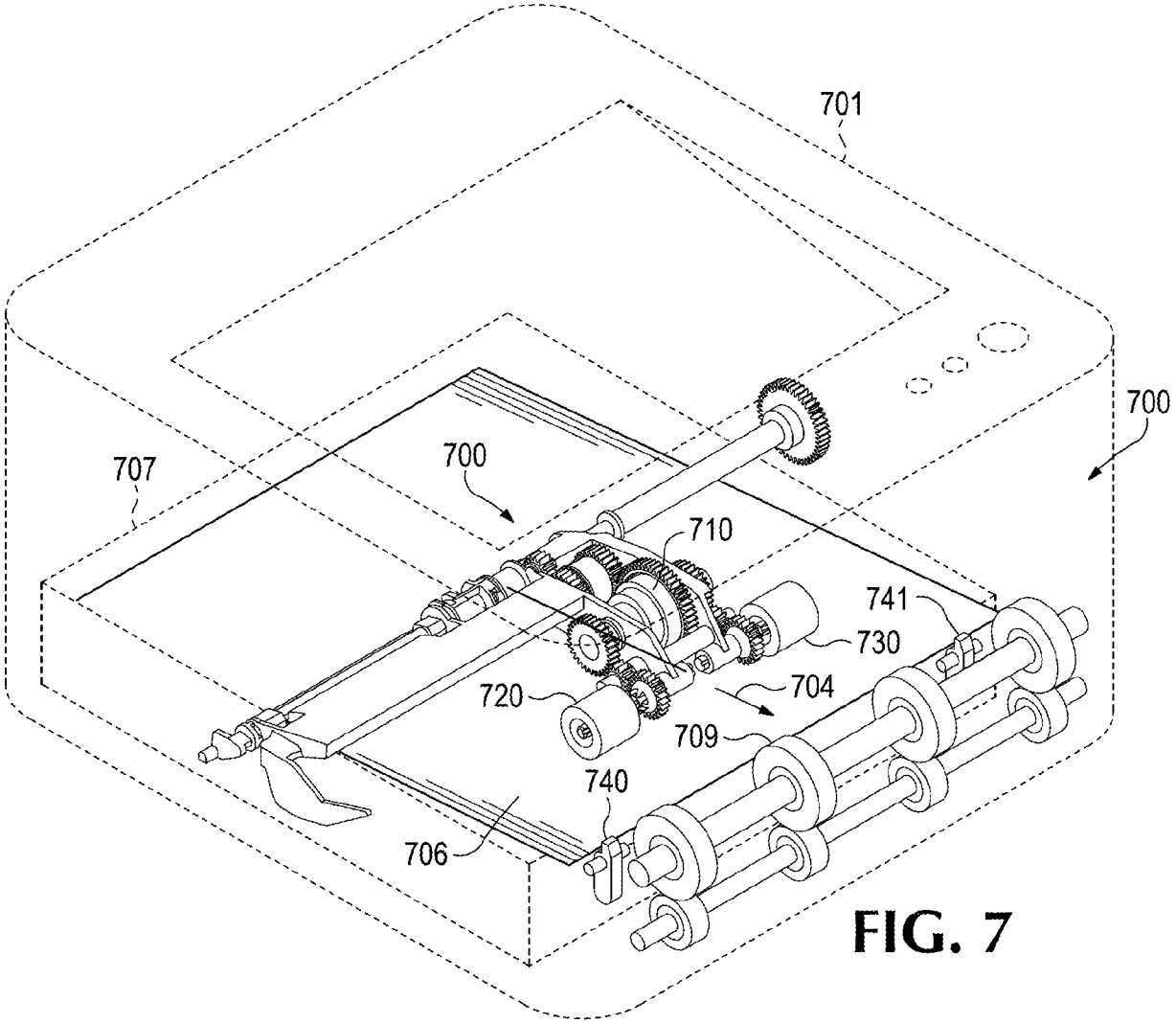
FIG. 7 is a perspective view of an apparatus including a differential and a gate according to an example.

FIG. 7 is a perspective view of an apparatus 700 including a differential 710 and a gate 740 according to an example. The differential 710 is to drive the first pick wheel 720 and second pick wheel 730, to drive the sheet 706 along the feed path 704 toward the turn roller 709. The sheet 706 is to encounter the gate 740, including a plurality of subgates 741. The differential 710 is to reduce skew in the sheet 706 when picked from the tray 707 in the printer body 701 and driven along the feed path 704.

As illustrated, the sheet 706 has encountered a plurality of subgates 740, 741, and sheet 706 is shown deskewed. Thus, the combined driving force from the first pick wheel 720 and the second pick wheel 730 will meet or exceed the gate resistance force and cause the subgates 740, 741 to retract and allow the sheet 706 to advance along the feed path 704. The gates 740, 741 may be passively controlled by weighting, and tied to each other via a gate shaft, such that the gate resistance force is generated by gravity and calibrated to achieve deskewing. A spring force may be used to generate the passive gate resistance force, without relying on gravity.

Figure 8:
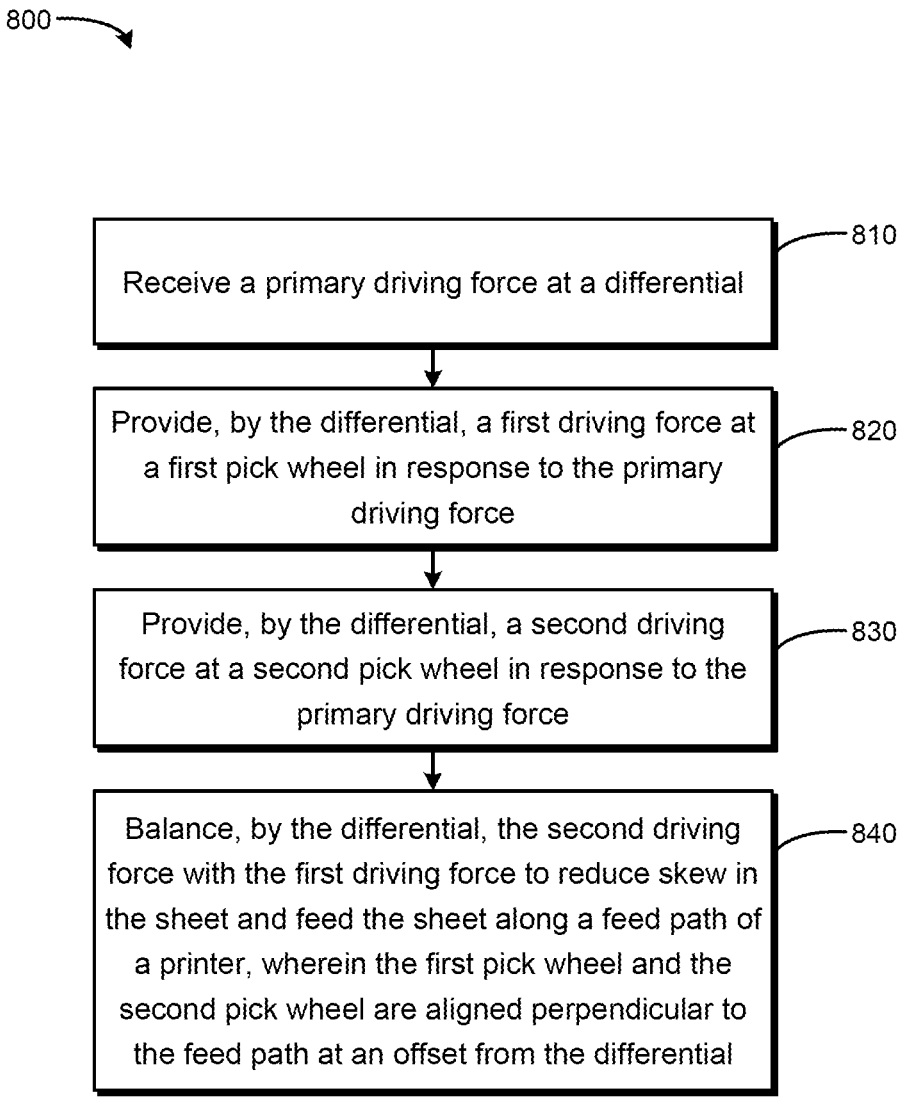
FIG. 8 is a flow chart based on a differential to provide driving forces according to an example.

FIG. 8 is a flow chart 800 based on a differential to provide driving forces according to an example. In block 810, the differential is to receive a primary driving force. For example, the differential may receive the primary driving force from a single motor via a primary gearset and drive shaft, enabling an apparatus based on the differential to rotate about a pick pivot without interrupting delivery of the primary driving force, providing balanced power delivery despite disturbances. In block 820, the differential is to provide a first driving force at a first pick wheel in response to the primary driving force. For example, the differential may be offset from the first pick wheel, such that the first pick wheel is coupled to the differential by a first gearset to deliver the first driving force. In block 830, the differential is to provide a second driving force at a second pick wheel in response to the primary driving force. For example, the differential may be offset from the second pick wheel, such that the second pick wheel is coupled to the differential by a second gearset. In block 840, the differential is to balance the second driving force with the first driving force to reduce skew in the sheet and feed the sheet along a feed path of a printer, wherein the first pick wheel and the second pick wheel are aligned perpendicular to the feed path at an offset from the differential. For example, the differential may compensate for irregularities or other differences in traction between the first pick wheel and the second pick wheel, such that the differential is able to deskew the sheet and deliver balanced torque.

Figure 9:
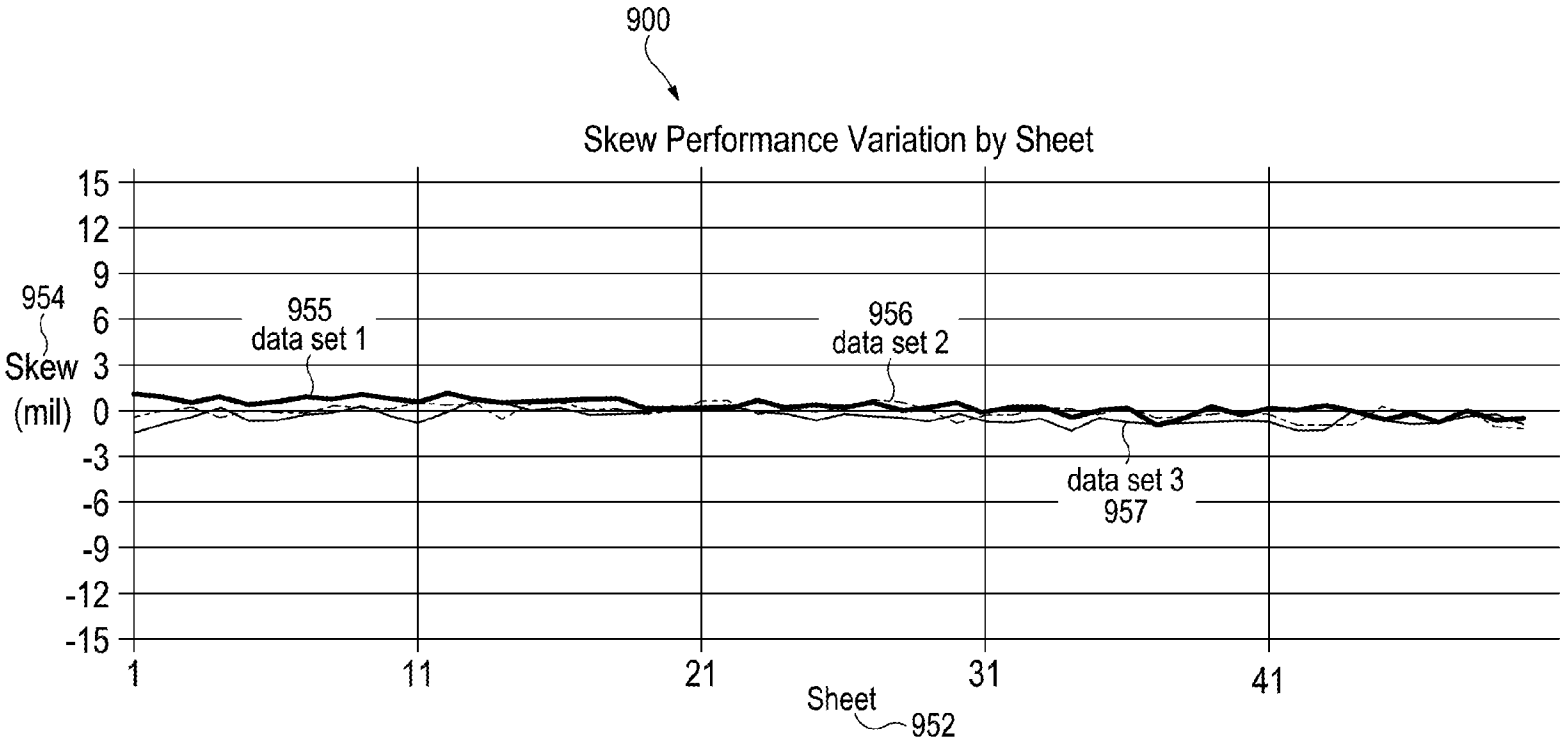
FIG. 9 is a chart of skew performance variation by sheet according to an example.

FIG. 9 is a chart 900 of skew performance variation by sheet according to an example. The horizontal axis represents a number of sheets 952 that were picked by an example apparatus. The vertical axis represents skew 954 of a sheet, measured in mils ($1/1000^{th}$ of an inch). Positive skew represents skew in a clockwise direction, and negative skew represents skew in a counterclockwise direction. Three data sets were collected, data set 1 (955), data set 2 (956), and data set 3 (957). The three data sets illustrate very low levels of skew 954 across the different sheets and data sets.

The skew of the sheet was measured at values ranging from −1.5 to 1.3 mil/inches using a skew test. As a comparison, typical skew ranges for other printers may be +/−6 mil/inches. Chart 900 is a run chart that plots the skew data from a first point to last point, with sixty data points shown per run, repeated for three runs to obtain data sets 1-3. Chart 900 therefore demonstrates how skew performance varies from sheet to sheet throughout a run, for one particular example. However, other results are possible if additional runs are performed, and further improvements to the skew results are possible.

Figure 10:
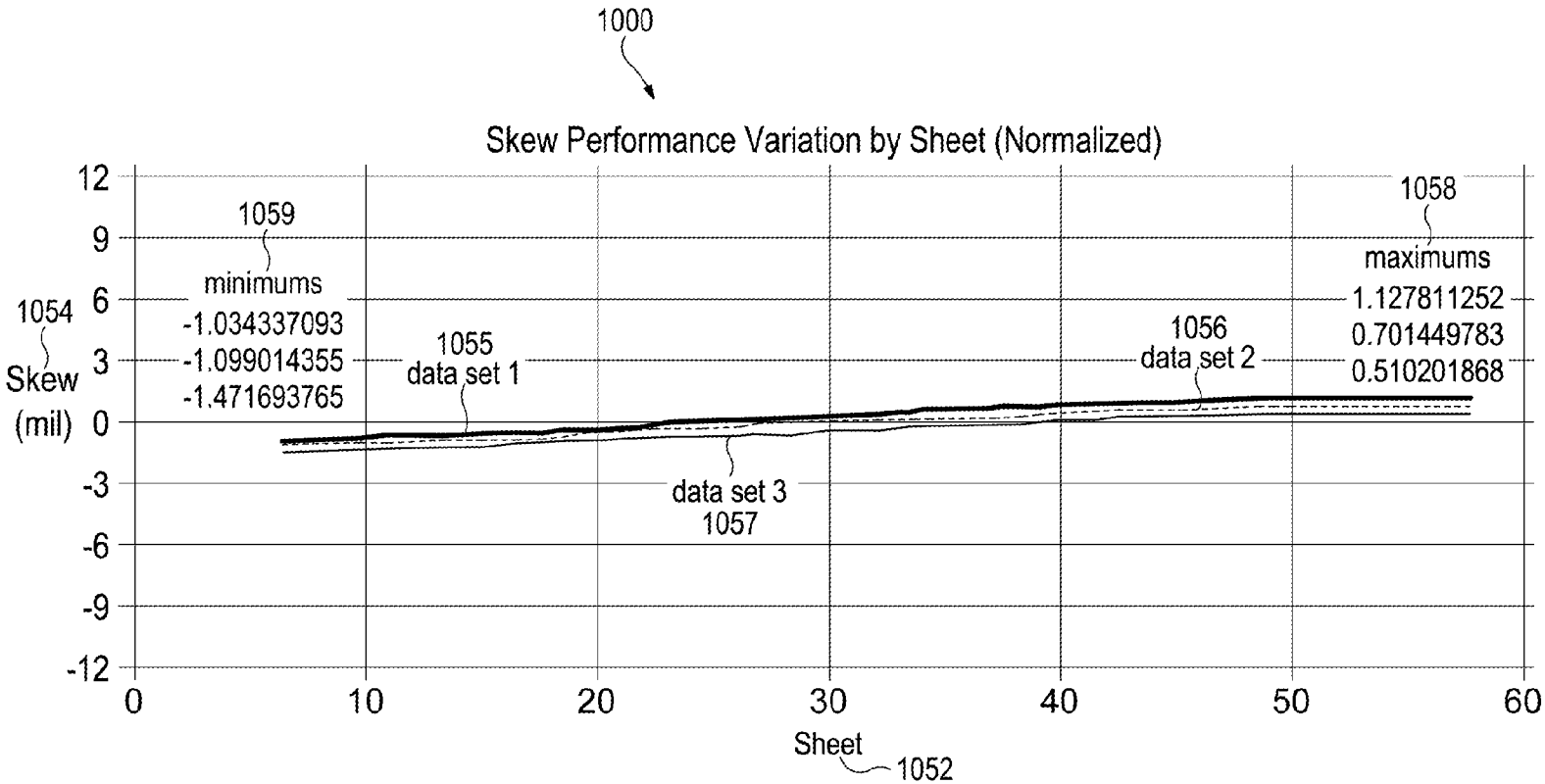
FIG. 10 is a chart of normalized skew performance variation by sheet according to an example.

FIG. 10 is a chart 1000 of normalized skew performance variation by sheet according to an example. The horizontal axis represents a number of sheets 1052 that were picked by an example apparatus. The vertical axis represents skew 1054 of a sheet, measured in mils ($1/1000^{th}$ of an inch). FIG. 10 illustrates the three data sets of FIG. 9, rearranged from minimum to maximum in skewness. Chart 1000 thus illustrates minimums 1059 and maximums 1058 for the data set 1 (1055), data set 2 (1056), and data set 3 (1057).

Normalization of the data from chart 900 of FIG. 9 enables visualization of the minimum, maximum, and variation of skewness achieved by examples disclosed herein. The minimums over the three runs did not exceed 1.5 mils, and the maximums over the three runs did not exceed 1.2 mils. Furthermore, unlike other printers that may typically demonstrate a pattern of excess skew in one direction (e.g., consistently positive skew), chart 1000 demonstrates that skew is nicely distributed symmetrically in both the positive and negative directions. Additional examples may provide other results, including performing additional runs to obtain additional data sets.

What is claimed is:

1. An apparatus comprising:

a body;

a differential, provided on the body, to receive a primary driving force and to provide a first driving force and a second driving force;

a first pick wheel, coupled to a first axel, to rotate about the first axel to move a sheet along a feed path;

a second pick wheel, coupled to a second axel, to rotate about the second axel to move the sheet along the feed path;

a first plurality of gears, provided on a first side of the body, that (i) is coupled to the differential and the first axel of the first pick wheel, (ii) enables the first axel to be offset from the differential, and (iii) receives the first driving force and transfers the first driving force to the first pick wheel; and a second plurality of gears, provided on a second side of the body, that (i) is coupled to the differential and the second axel of the second pick wheel, (ii) enables the second axel to be offset from the differential, and (iii) receives the second driving force and transfers the second driving force to the second pick wheel;

wherein the differential is to balance the first driving force and the second driving force to reduce skew in the sheet as the sheet is moved along the feed path.

2. The apparatus of claim 1, wherein the differential is to provide a combined driving force based on a sum of the first driving force and the second driving force, wherein the combined driving force is greater than a gate resistance force to be encountered by the sheet when traversing the feed path, wherein the gate resistance force is greater than the first driving force or second driving force individually.

3. The apparatus of claim 1, further comprising a pick pivot and a spring to bias the first pick wheel and the second pick wheel about the pick pivot into a pick position to feed the sheet along the feed path.

4. The apparatus of claim 1, further comprising a pick pivot, wherein the differential is offset from the pick pivot.

5. The apparatus of claim 1, wherein the differential is to receive the primary driving force based on a single motor to provide the first driving force and the second driving force.

6. The apparatus of claim 1, wherein the differential is to compensate for a diameter difference between a first diameter of the first pick wheel and a second diameter of the second pick wheel, to provide the first driving force and the second driving force.

7. The apparatus of claim 1, wherein the differential is to compensate for a traction difference between a first traction of the first pick wheel and a second traction of the second pick wheel, to provide the first driving force and the second driving force.

8. The apparatus of claim 1, wherein the differential is to compensate for a contact area difference between a first contact area of the first pick wheel and a second contact area of the second pick wheel, to provide the first driving force and the second driving force.

9. The apparatus of claim 1, wherein the first axel and the second axel have different lengths.

10. The apparatus of claim 1, further comprising a one-way clutch, wherein the differential is to receive the primary driving force via the one-way clutch.

11. A method of operating an apparatus for a printer, the method comprising:

receiving a primary driving force at a differential, the differential being provided on a body of the apparatus;

providing, by the differential, a first driving force and a second driving force in response to receiving the primary driving force to move a sheet along a feed path, the first driving force being provided to a first plurality of gears provided on a first side of the body and the second driving force being provided to a second plurality of gears provided on a second side of the body, wherein a first plurality of gears is coupled to the differential and a first axel of a first pick wheel and is to transfer the first driving force to the first pick wheel, and wherein a second plurality of gears is coupled to the differential and a second axel of a second pick wheel and is to transfer the second driving force to the second pick wheel;

balancing, by the differential, the second driving force with the first driving force to reduce skew in the sheet as the sheet is moved along the feed path.

12. The method of claim 11, wherein the differential provides the first driving force and the second driving force by compensating for a diameter difference between a first diameter of the first pick wheel and a second diameter of the second pick wheel.

13. The method of claim 11, wherein the differential provides the first driving force and the second driving force by compensating for a traction difference between a first traction of the first pick wheel and a second traction of the second pick wheel.

14. The method of claim 11, wherein the differential provides the first driving force and the second driving force by compensating for a contact area difference between a first contact area of the first pick wheel and a second contact area of the second pick wheel.

15. The method of claim 11, further comprising pivoting the differential, the first pick wheel, and the second pick wheel about a pick pivot such that the first pick wheel and the second pick wheel are to contact the sheet.

* * * * *